United States Patent [19]

Kennedy et al.

[11] 3,980,331

[45] Sept. 14, 1976

[54] DOOR CHECK AND HOLD-OPEN DEVICE

[75] Inventors: Thomas E. Kennedy; James F. Kinney, both of Niles, Mich.

[73] Assignee: Tyler Refrigeration Corporation, Niles, Mich.

[22] Filed: Sept. 18, 1975

[21] Appl. No.: 613,389

[52] U.S. Cl. ..... 292/268; 16/82; 248/293

[51] Int. Cl.[2] ..... E05C 17/16

[58] Field of Search ..... 16/49, 82, DIG. 17; 292/268, 275, 338; 248/240 A, 293

[56] References Cited

UNITED STATES PATENTS

| | | | |
|---|---|---|---|
| 1,532,239 | 4/1925 | Fauser | 16/82 |
| 1,895,895 | 1/1933 | Norton | 16/49 |
| 1,960,024 | 5/1934 | Paris | 292/268 |
| 2,905,965 | 9/1959 | Flint | 16/49 |
| 2,958,089 | 1/1960 | Roehm et al. | 16/49 |
| 3,103,692 | 9/1963 | Ruck, Jr. et al. | 16/82 |

*Primary Examiner*—Werner H. Schroeder
*Assistant Examiner*—Conrad L. Berman
*Attorney, Agent, or Firm*—LeBlanc & Shur

[57] ABSTRACT

A door check having a slidable arm mounted on a multi-stepped shoulder fastener has means for pivotally mounting the arm on the door of a refrigerator display case or like apparatus at one end thereof and has an elongated slot extending from the mid portion of the arm to an opposite end thereof which receives the shoulder fastener. A restriction is provided in the slot near the outer end thereof. The fastener is mounted on the display case and engages the outer end of the slot when the door of the display case is swung to the full open position. The hold the door open the arm can be moved upwardly so that the restriction in the slot bears against an enlarged shoulder of the multi-stepped fastener to retain the door in the open position. Pressure on the door toward the closed position spreads the restriction in the slot apart to drop the arm and permit travel of the door to the closed position without damage to the door stop. In the alternative, pressure on the door toward the open position disengages the enlarged shoulder from the restriction and allows the arm to drop back to its normal position so as to permit travel of the door.

2 Claims, 2 Drawing Figures

DOOR CHECK AND HOLD-OPEN DEVICE

BACKGROUND AND SUMMARY OF THE INVENTION

Door check and hold-open devices of various configurations have been provided on doors opening in a single direction, such as the doors of a refrigerator display case. Typical door check devices limit the outward travel of the door. Such devices may also incorporate means for retaining the door in the open position, as during periods when supplies stored in the case are being replenished.

It would be desirable to provide a hold-open device of such construction that pressure on the door exerted toward either the closed or open position will automatically release the hold-open device without damage thereto. Further, it would be desirable if the hold-open device were relatively simple, involving a minimum of parts.

It is the object of the present invention to provide a combination door check and hold open device which will limit the travel of the door as it is swung open, can be activated to positively retain the door in the hold-open position, yet can be alternately released easily from the hold-open position.

Another object of the present invention is to provide a door check and hold-open device of relatively simple construction having a minimum of moving parts.

Further objects and advantages of this invention will be apparent to persons skilled in the art from the following detailed description of a preferred embodiment accompanied by the attached drawings wherein identical reference numerals will refer to like parts for various views.

DETAILED DESCRIPTION OF A PREFERRED EMBODIMENT

Figure 2:
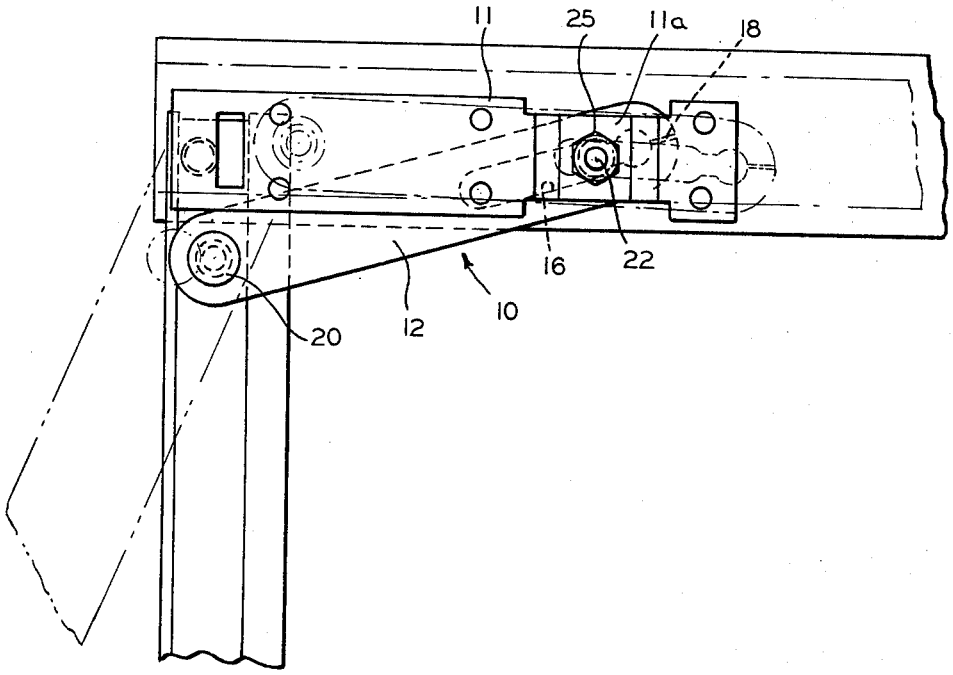
FIG. 2 is a somewhat diagrammatic plan view illustrating the operation of the hold-open device of the present invention.
Figure 1:
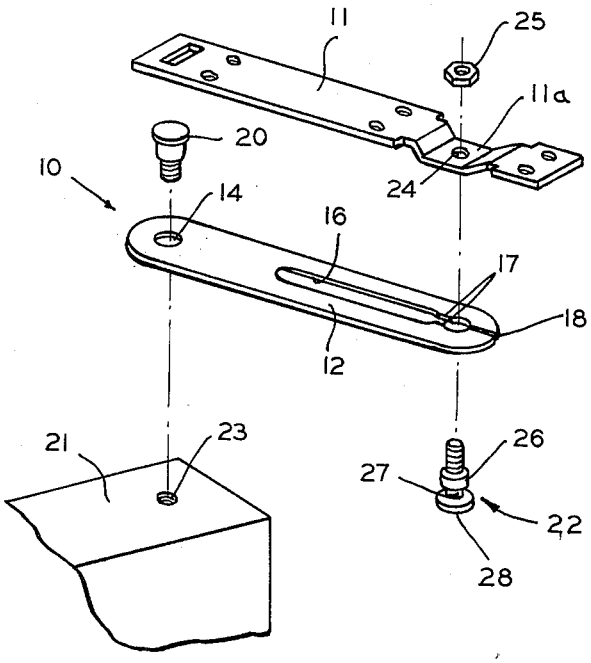
FIG. 1 is an exploded perspective view of a combination door check and hold-open device constructed in accordance with the present invention.

Referring now to FIG. 1, the door check and hold-open device of the present invention may be generally designated as 10 and includes a hinge plate 11 having a step 11*a* therein, suitably mounted on the upper sill of a door opening for a display case (not shown) with a door check arm 12 underlying the hinge plate 11 in generally parallel alignment when the door is closed. The door check arm 12 comprises an elongated metal bar preferably formed of spring steel, having a hole 14 provided at one end thereof, and having an elongated slot 16 disposed on the longitudinal axis of the arm 12 and extending from the mid point of the arm 12 to an outer end thereof. A restriction 17 is provided in the slot 16 somewhat inside of its outer end as shown in FIG. 2. A slit 18 extends from the outer end of the slot 16 to the outer edge of the arm 12 to bifurcate the outer portion of the arm 12 and accentuate the spring action of the arm 12. A pivot pin 20 is received in the opening 14 in the arm 12 and passes therethrough to engage an aligned opening 23 provided in a door 21 of the display case. A multi-stepped pin 22 is also associated with the arm 12 and is received in the slot 16 and an aligned opening 24 provided in the hinge plate 11 mounted on the display case. A nut 25 associated with the opening 24 secures the pin 22 to the hinge plate 11. The pin 22 includes an enlarged inner shoulder 26, a somewhat smaller grooved portion 27 and an enlarged head 28. The diameter of the enlarged head 28 is substantially larger than the width of the slot 16, the slot 16 however, being large enough to accommodate the shoulder 26 of the pin 22. Although the restriction 17 in the slot 16 would not accommodate the enlarged head portion 26 of the pin 22, the restriction 17 does accommodate the grooved portion 27 of the pin 22. The slit 18 is substantially smaller than the grooved portion 27 of the pin 22, the grooved portion 27 being the smallest diameter of the pin 22.

Operation of the Preferred Embodiment

With the door 21 in the closed position the arm 12 underlies the hinge plate 11 in generally parallel relationship with the pin 22 lying at the inner end of the slot 16. When the door 21 is opened, the arm 12 both pivots about the pin 20 and translates outwardly. As the arm 12 is translated outwardly, the relative position of the pin 22 within the slot 16 changes so as to place the pin 22 at the outer end of the slot 16 beyond the restriction 17 when the door is in the fully opened position. Engagement of the outer end of the slot 16 with the pin 22 at the fully opened position prevents further travel of the door outwardly. Pushing the arm 12 upwardly, whereby the outer edges of the slot 16 and the restriction 17 form a peripheral edge which engages the enlarged shoulder 26 of the pin 22, retains the door 21 in the fully opened position. The door is resiliently biased toward the closed position by any known means (not shown).

To close the door, the arm 12 need not be manually separated from the shoulder 26 of the pin 22. Pressure exerted against the door 21 in the opening direction disengages the shoulder 26 from the restriction 17 to permit the arm 12 to drop into the plane of the grooved portion 27 of the pin 22 for free reciprocable movement between the open and closed positions of the door 21. In the alternative pressure directed to the door in the closing direction actuates the leaf spring action in the arm 12 provided by the slit 18 to open the restriction 17 and carry the pin 22 into the larger slot area 16, to again drop the arm 12 into the plane of the grooved portion 27 of the pin 22 for freely reciprocable movement.

Thus the present invention provides a relatively simple construction, whereby a door may be checked at a maximum hold-open position and held therein by the action of the hold-open device. Further, the door may be released through either of the two alternate ways from the hold-open position without damage to the device associated therewith.

Having thus described in detail a preferred embodiment of the invention, persons skilled in the art will be able to modify certain of the structure that has been illustrated and substitute equivalent elements for those which have been disclosed, and it is therefore, intended that all such modifications and substitutions be covered if they are embraced within the spirit and scope of the appended claims.

We claim:

1. A door check and hold-open device adapted to be secured to a door and a frame, the door having resilient means biasing the door to a closed position with respect to the frame, said device comprising:

a. mounting means adapted to be secured on said frame;

b. an elongated resilient door check arm located in a generally parallel plane with said mounting means, said arm having an aperture provided near one end thereof and having a longitudinal slot on the longitudinal axis of said arm extending from about the midpoint thereof to near another end thereof;

c. means, projecting through said aperture, for pivotally connecting said one end of said arm to said door;

d. a multi-stepped pin projecting through said longitudinal slot, for connecting said arm to said mounting means, has one end thereof attached to said mounting means and further includes an enlarged head portion on a side of said arm removed from said mounting means, an intermediate groove portion and a shoulder portion, said slot being slightly wider than said pin groove and shoulder portions; and e. said door check arm further including a restriction, wide enough to accommodate free passage of said pin groove portion, close to the end of said longitudinal slot near said another end of said arm, whereby as said door is opened to a fully opened position, said door carries said arm relative to said pin so as to locate said pin beyond said restriction in said slot, whereafter said arm can be slightly displaced from said parallel plane so that said restriction engages the shoulder portion of said pin when said door is released, to prevent said door from returning to a closed position, said door being closable by said resilient biasing means upon its release from its fully open position in a first of two alternate ways after a force is initially exerted against said door in a door-opening direction thereby disengaging said pin shoulder portion from said restriction and permitting said arm to return to said generally parallel plane wherein said longitudinal slot is generally in the plane of said pin groove portion.

2. A door check and hold-open device as claimed in claim 1 wherein a slit is provided outwardly of said slot in said another end of said arm to bifurcate said another end of said arm into opposite symmetric and resilient side portions, and said pin shoulder portion is larger than said restriction, said door also being closable by said resilient biasing means, upon its release from its fully open position in a second of said two alternate ways after a force is initially exerted against said door in a door-closing direction to force said pin shoulder portion through said restriction by spreading said opposite side portions and thereafter permitting said arm to return to said generally parallel plane.

* * * * *

UNITED STATES PATENT AND TRADEMARK OFFICE

CERTIFICATE OF CORRECTION

PATENT NO. : 3,980,331

DATED : September 14, 1976

INVENTOR(S) : Thomas E. Kennedy and James F. Kinney

It is certified that error appears in the above–identified patent and that said Letters Patent are hereby corrected as shown below:

IN THE ABSTRACT:

Line 11, "position. The" should read --position. To--.

Signed and Sealed this

Twenty-second Day of February 1977

[SEAL]

*Attest:*

RUTH C. MASON
*Attesting Officer*

C. MARSHALL DANN
*Commissioner of Patents and Trademarks*